US008776874B2

(12) United States Patent
Hu

(10) Patent No.: US 8,776,874 B2
(45) Date of Patent: Jul. 15, 2014

(54) HEAT EXCHANGER TUBES AND METHODS FOR ENHANCING THERMAL PERFORMANCE AND REDUCING FLOW PASSAGE PLUGGING

(75) Inventor: Zaiqian Hu, Carmel, IN (US)

(73) Assignee: Valeo, Inc., Auburn Hills, MI (US)

( * ) Notice: Subject to any disclaimer, the term of this patent is extended or adjusted under 35 U.S.C. 154(b) by 1666 days.

(21) Appl. No.: 11/967,245

(22) Filed: Dec. 30, 2007

(65) Prior Publication Data

US 2009/0166016 A1 Jul. 2, 2009

(51) Int. Cl.
*F28D 1/053* (2006.01)
*F28F 1/02* (2006.01)
*F28F 13/08* (2006.01)

(52) U.S. Cl.
USPC ..... 165/178; 165/79; 165/146; 165/177

(58) Field of Classification Search
CPC ..... F28F 1/022; F28F 13/08; F28D 1/05316; F28D 1/05333; F28D 1/05366; F28D 1/05383
USPC ..... 165/177, 140, 146, 79, 178
See application file for complete search history.

(56) References Cited

U.S. PATENT DOCUMENTS

| | | | | | |
|---|---|---|---|---|---|
| 3,708,012 | A * | 1/1973 | Zimprich | 165/79 |
| 4,570,700 | A * | 2/1986 | Ohara et al. | 165/177 |
| 5,172,761 | A * | 12/1992 | Lyon | 165/173 |
| 5,174,373 | A * | 12/1992 | Shinmura | 165/146 |
| 5,186,244 | A * | 2/1993 | Joshi | 165/140 |
| 5,491,997 | A | 2/1996 | Ogawa | |
| 5,567,493 | A * | 10/1996 | Imai et al. | 428/36.9 |
| 6,216,776 | B1 * | 4/2001 | Kobayashi et al. | 165/177 |
| 6,793,012 | B2 * | 9/2004 | Fang et al. | 165/140 |
| 6,854,512 | B2 * | 2/2005 | Lee et al. | 165/177 |
| 6,973,965 | B2 * | 12/2005 | Meshenky | 165/177 |
| 7,059,399 | B2 * | 6/2006 | Chin et al. | 165/177 |
| 7,836,944 | B2 * | 11/2010 | Antonijevic et al. | 165/177 |
| 2002/0066554 | A1 | 6/2002 | Oh et al. | |
| 2007/0119581 | A1 | 5/2007 | Kato | |
| 2010/0011804 | A1 * | 1/2010 | Taras et al. | 165/178 |

FOREIGN PATENT DOCUMENTS

| | | | | |
|---|---|---|---|---|
| JP | 61202084 | A * | 9/1986 | 165/140 |
| JP | 2000266484 | A | 9/2000 | |
| JP | 2001059689 | A | 3/2001 | |
| JP | 2005127597 | A | 5/2005 | |

OTHER PUBLICATIONS

International Search Report for Application No. PCT/US2008/088296 dated Aug. 17, 2009 (12 pages).
International Preliminary Report on Patentability for Application No. PCT/US2008/088296 dated Jul. 15, 2010 (7 pages).

* cited by examiner

*Primary Examiner* — Leonard R Leo
(74) *Attorney, Agent, or Firm* — Dierker & Associates, P.C.

(57) ABSTRACT

Heat exchanger tubes are disclosed herein. An embodiment of a heat exchanger tube includes a tube body having two opposed sides. A plurality of exterior flow passages is defined in the tube body adjacent one of the two opposed sides. A plurality of interior flow passages is defined in the tube body adjacent the plurality of exterior flow passages. The plurality of exterior flow passages has at least one of an average hydraulic diameter or an average width that is i) greater than at least one of an average hydraulic diameter or an average width of the interior flow passages and ii) less than twice the at least one of the average hydraulic diameter or the average width of the interior flow passages.

17 Claims, 2 Drawing Sheets

HEAT EXCHANGER TUBES AND METHODS FOR ENHANCING THERMAL PERFORMANCE AND REDUCING FLOW PASSAGE PLUGGING

BACKGROUND

The present disclosure relates generally to heat exchanger tubes, and to methods for enhancing thermal performance and reducing flow passage plugging of such heat exchanger tubes.

Two goals for heat exchanger manufacturing often include forming a product that exhibits efficient transfer of heat, while maintaining a relatively simple manufacturing process. In the automotive industry, in particular, it has also become desirable to combine multiple functions into a single heat exchanger assembly. As such, multiple tubes, fins, manifolds and/or end tanks have been implemented into single heat exchanger assemblies. Furthermore, the tubes used in heat exchangers, especially condenser tubes and oil cooler tubes, often include one or more flow passages formed therein. In theory, such flow passages are supposed to contribute to higher thermal efficiency of the tubes in which they are incorporated.

BRIEF DESCRIPTION OF THE DRAWINGS

Features and advantages of embodiments of the present disclosure will become apparent by reference to the following detailed description and drawings, in which like reference numerals correspond to the same or similar, though perhaps not identical, components. For the sake of brevity, reference numerals having a previously described function may or may not be described in connection with subsequent drawings in which they appear.

DETAILED DESCRIPTION

Embodiments of the heat exchanger tubes disclosed herein advantageously include multiple flow passages, the hydraulic diameters and/or width of which vary from at least one flow passage to at least another flow passage. Generally, an average hydraulic diameter and/or width of one group of flow passages is greater than an average hydraulic diameter and/or width of another group of flow passages. During manufacture, the heat exchanger tubes may be brazed to other components, for example, a header.

One non-limiting example of such a brazing technique is controlled atmosphere brazing. Controlled atmosphere brazing employs a brazing alloy for attaching components that are formed of materials with higher melting points than the brazing alloy. The brazing alloy is positioned between components (or surfaces thereof) to be joined and, subsequently, the brazing alloy is heated and melted (e.g., in an oven or furnace, and often under a controlled atmosphere). Upon cooling, the brazing alloy forms a metallurgical bond with the components, thereby attaching the components together. Brazing paste or flux is used to improve wetting of the two pieces to be joined with the melted brazing material. Such materials aid in the pieces sticking together.

Such processing may result in the plugging of one or more flow passages, due, at least in part, to the amount of brazing material (e.g., flux, paste or clad) present. In the embodiments of the heat exchanger 100 and assembly 1000 shown in FIGS. 1A and 1B, the sides S1, S2 of the tubes 10, 10' (see FIG. 1C) are oriented such that one side S1, S2 faces up, and the other side S2, S1 faces down. Either side S1, S2 may face upward or downward due, at least in part, to tube 10, 10' handling and assembling. As such, flow passages at either side S1, S2 may be susceptible to plugging, depending, at least in part, on the tube 10, 10' orientation. Gravity causes brazing material to move downward toward one side S2, S1 of the tube 10, 10', thereby increasing the likelihood of plugging of the flow passages adjacent that particular side S2, S1. It is to be understood that plugging of the flow passages may result in the prevention/restriction of fluid (e.g., refrigerant) flow through the passages, and thus a reduction of the thermal efficiency of the tubes 10, 10'.

Figure 2:
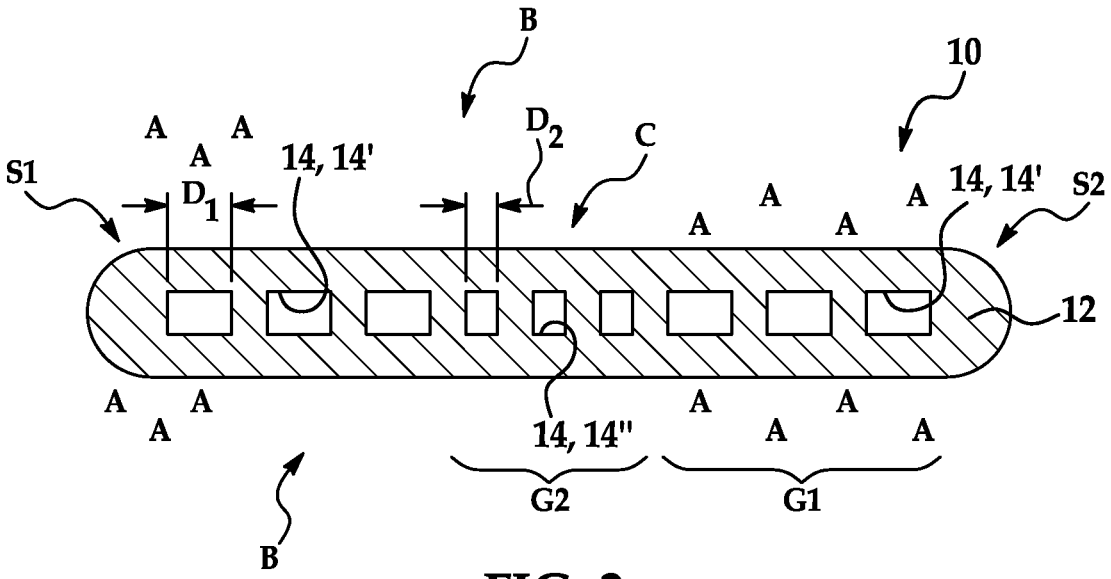
FIG. 2 is a schematic cross-sectional view of the heat exchanger tube of FIG. 1C taken along line 2-2.
Figure 3:
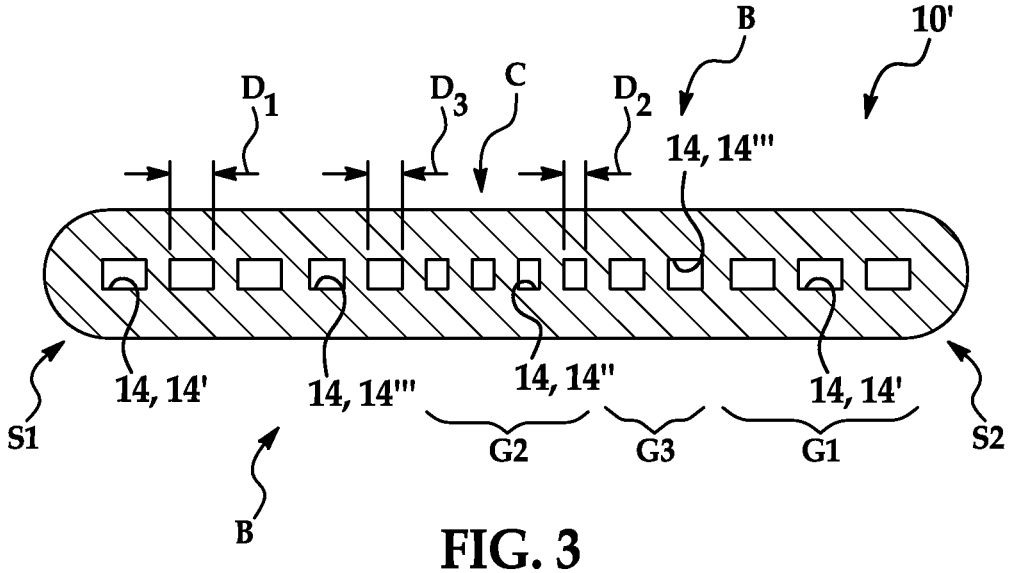
FIG. 3 is a schematic cross-sectional view, similar to that shown in FIG. 2, of another embodiment of a heat exchanger tube.

Without being bound to any theory, it is believed that the varying flow passage hydraulic diameters and/or width disclosed herein advantageously reduce flow passage plugging (i.e., clogging of flow passages with, for example, brazing paste or clad) and fluid by-passing (i.e., fluid disproportionately moving through some flow passages and by-passing other flow passages). The reduction of plugging and fluid by-passing also advantageously increases heat exchanger efficiency. It is further believed that the positioning of the flow passages with larger hydraulic diameters and/or widths at the sides S1, S2 of the tubes 10, 10' (when viewing a cross-section of a flat tube, for example, as seen in FIGS. 2 and 3) and extending toward the center of the tube 10, 10' (when viewing a cross-section of a flat tube, for example, as seen in FIGS. 2 and 3), or adjacent brazing migration areas, reduces flow passage plugging. Still further, it is believed that the difference in the varying flow passage hydraulic diameters and/or widths is small enough to reduce or prevent fluid from by-passing the smaller flow passages.

Figure 1A:
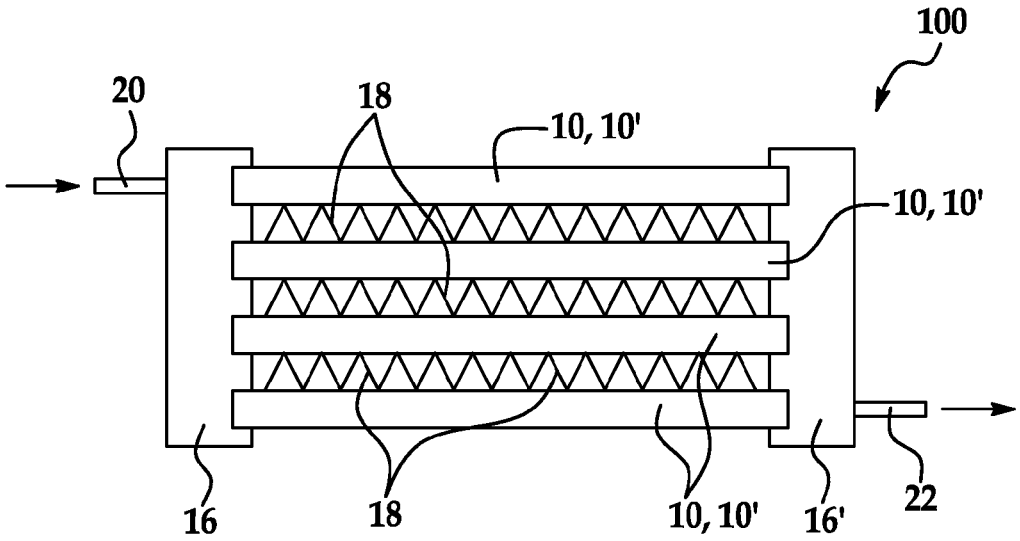
FIG. 1A is a schematic side view of an embodiment of a heat exchanger.

FIG. 1A depicts an embodiment of a single heat exchanger 100 (a non-limiting example of which is a condenser). The heat exchanger 100 generally includes first and second end tanks 16, 16', a plurality of tubes 10, 10' extending between the end tanks 16, 16', and fins 18 separating each of the plurality of tubes 10, 10'. As shown in FIG. 1A, the heat exchanger 100 includes an inlet 20 on one end tank 16 and an outlet 22 on the other end tank 16'. In other instances, the inlet 20 and outlet 22 may be on the same end tank 16, 16'.

Figure 1B:
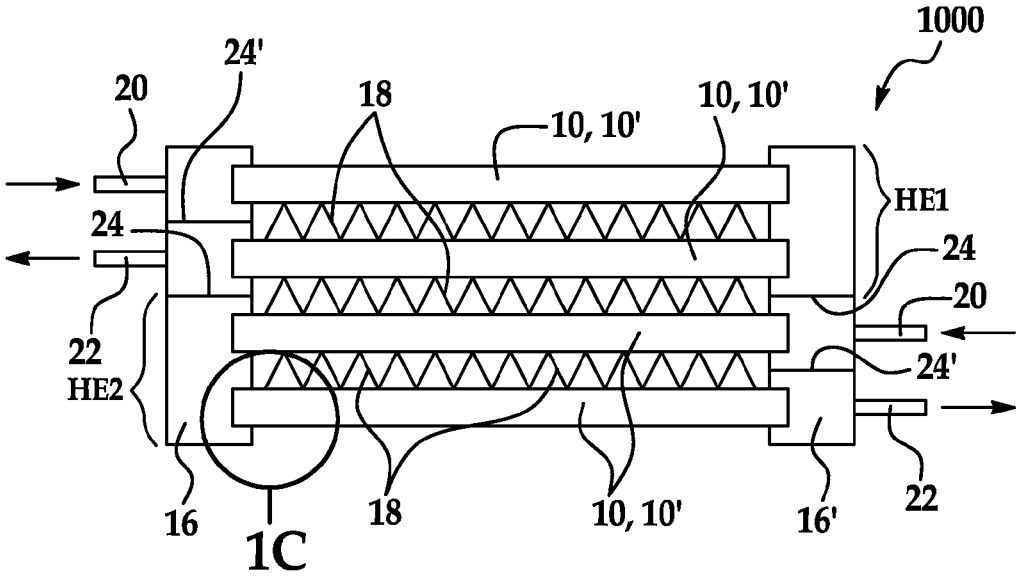
FIG. 1B is a schematic side view of an embodiment of a heat exchanger assembly.

FIG. 1B depicts an embodiment of a heat exchanger assembly 1000. The assembly 1000 (a non-limiting example of which is a combo-cooler) includes at least two heat exchangers HE1, HE2 operatively disposed between the two end tanks 16, 16'. Baffles 24 in each of the end tanks 16, 16' separate the heat exchangers HE1, HE2 from each other. As depicted, each heat exchanger HE1, HE2 includes a respective inlet 20 and a respective outlet 22. It is to be understood that additional baffles 24' may be positioned within one or both end tanks 16, 16' to direct the flow of fluid within a particular heat exchanger HE1, HE2.

It is to be understood that one or more of the tubes 10, 10' in the heat exchanger 100 and the heat exchanger assembly 1000 includes flow passages (shown in FIGS. 2 and 3) having varying hydraulic diameters. Such tubes 10, 10' are described in more detail in reference to the other figures.

Figure 1C:
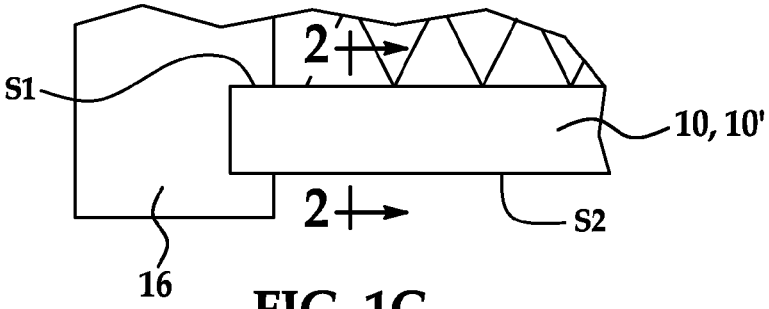
FIG. 1C is an exploded view of a portion of a heat exchanger tube shown in FIG. 1B.

FIG. 1C is an exploded view of a portion of the tube 10, 10' shown in FIG. 1B. As illustrated (and briefly discussed hereinabove), the sides S1, S2 of the tube 10, 10' are oriented such that one S1 faces upward and the other S2 faces downward.

Referring now to FIG. 2, a cross-sectional view taken along the 2-2 line of the tube 10 of FIG. 1C is depicted. Generally, the tube 10 includes a tube body 12, and a plurality of flow passages 14 defined in the tube body 12. As depicted, each of the flow passages 14 is fluidly separated from each of the other flow passages 14. Any suitable process may be used to form the tube 10 and flow passages 14, including, but not limited to extrusion, roll-forming, or bending and brazing.

The tube body 12 may be formed of any suitable material, including copper and copper alloys, aluminum and various aluminum alloys.

The tube body 12 has two opposed sides 51, S2 and a bottom B. The portion of the tube body 12 that is the bottom B may vary, depending, at least in part, on the orientation of the tube 10, 10'. During manufacturing of a heat exchanger 100 (a non-limiting example of which is shown in FIG. 1A), for example, when the tube(s) 10, 10' are brazed, one or both of the opposed sides S1, S2 and/or the bottom B may be exposed to more extreme brazing conditions and effects (e.g., due to gravity). When brazing takes place, area(s) A, located external to the tube 10, 10' where brazing paste/clad is more prevalent (i.e., significant amounts of such material(s) are present), are referred to as "brazing migration areas." Brazing migration (i.e., movement of brazing flux/paste/clad) is likely to occur at these area(s) A, at least in part because of the amount of material present, for example, due to gravitational forces pulling the brazing material downward. It is to be understood that the extent of the brazing migration area(s) A depends, at least in part, on the positioning of the tube(s) 10, 10', on where brazing occurs, how much paste/clad is used, and/or other like brazing conditions.

The heat exchanger 100 and assembly 1000 of FIGS. 1A and 1B are shown positioned in a substantially vertical orientation (where the tubes 10, 10' are stacked). This substantially vertical orientation is generally the position in which the heat exchanger 100 or assembly 1000 is placed into the vehicle. During brazing, however, the radiator/heat exchanger 100 or assembly 1000 is often positioned horizontally. FIGS. 2 and 3 illustrate the tubes 10, 10' when the heat exchanger 100 or assembly 1000 is in a horizontal orientation. The bottom B (or lowest) portion of the flow passages 14 may be more likely to be filled with the brazing material, due, at least in part, to the gravitational force. In this instance, the brazing migration area A would be close to the bottom B part of the tube 10, 10' due to the horizontal orientation. As previously mentioned, it is to be understood that the bottom B may vary, depending on the orientation of the heat exchanger 100 or assembly 1000 during brazing.

In another non-limiting example, the brazing migration area A may be close to the baffle 24 or 24', as shown in FIG. 1B. Generally, the outer surface of the baffle 24 or 24' accumulates a significant amount of brazing paste, which is likely to migrate to the nearest tube 10, 10' and fill in the flow passages 14 situated, for example, in the middle of that tube 10, 10'.

In an embodiment, as shown in FIG. 2, a group G1 (i.e., two or more) of flow passages 14, 14' has a greater average hydraulic diameter and/or width than the average diameter and/or width of another group G2 of flow passages 14, 14". Generally, the group G1 having the larger average hydraulic diameter and/or width is positioned adjacent at least one of the opposed sides S2, S1 or adjacent the brazing migration area(s) A. In some instances, the larger flow passages 14, 14' are formed beyond the brazing migration area(s) A. It is believed that the location of such larger flow passages 14, 14' advantageously reduces or prevents any migrating brazing material from plugging the flow passages 14. Some brazing material(s) may enter the flow passages 14, 14', however, the size of the flow passages 14, 14' substantially prevents complete blockage. Furthermore, it is believed that while the average size of the larger flow passages 14, 14' is sufficient to reduce/eliminate plugging, the average size is also small enough to contribute to enhanced thermal performance of the heat exchanger.

It is to be understood that the hydraulic diameter $D_1$, $D_2$ and/or width of each individual flow passage 14, 14', 14" is configured to obtain maximum effectiveness of the heat exchanger in which it is used. As used herein, the hydraulic diameter $D_x$ is determined according to the following equation:

$$D_X=4A_P/P_w$$

wherein $A_p$=wetted cross-sectional area of the passageway of a tube 10, 10'; and $P_w$=wetted perimeter of the tube 10, 10'.

Each of the variables ($P_w$ and $A_p$) for the hydraulic diameter ($D_X$) are determinable for a tube 10, 10' according to standard geometric and engineering principles and will depend, at least in part, upon the configuration and variable of a particular tube 10, 10'.

It is to be understood that each individual flow passage 14, 14' within the group G1 having the larger average hydraulic diameter and/or width may have the same or a different hydraulic diameter $D_1$ and/or width than each other individual flow passage 14, 14' in the group G1. For example, those larger flow passages 14, 14' in closer proximity to the side S2, S1 may have a slightly larger diameter $D_1$ and/or width than those larger flow passages 14, 14' in closer proximity to the smaller flow passages 14, 14". In still another non-limiting example, the hydraulic diameter $D_1$ and/or width of each larger flow passage 14, 14' may decrease moving from the side S2, S1 toward the center C. As specific non-limiting examples, two flow passages 14, 14' may have the same hydraulic diameter and/or width of 0.59 mm, or one flow passage 14, 14' may have a hydraulic diameter $D_1$ and/or width of 0.58 mm, while another flow passage 14, 14' may have a hydraulic diameter $D_1$ and/or width of 0.60 mm.

Similarly, it is to be understood that each individual flow passage 14, 14" within the group G2 having the smaller average hydraulic diameter and/or width may have the same or different hydraulic diameter $D_2$ and/or width than each other individual flow passage 14, 14" in the group G2.

While the larger flow passages 14, 14' may be defined in the tube body 12 at any location that is likely to be adjacent a brazing migration area A, in an embodiment, a plurality/group/set (i.e., more than one) of the larger flow passages 14, 14' is located at and near each of the two sides S1, S2. In the embodiment shown in FIG. 2, the exterior plurality/set (shown as group G1) includes three larger flow passages 14, 14' formed in tube body at each side S1, S2 (i.e., one flow passage 14, 14' is directly adjacent the particular side S1, S2, a second flow passage 14, 14' is adjacent the one flow passage 14, 14', etc.). The larger flow passages 14, 14' positioned adjacent the sides S1, S2 are also referred to herein as exterior flow passages 14, 14'.

As shown in FIG. 2, smaller flow passages 14, 14" are also defined in the tube body 12. The smaller flow passages 14, 14" are generally formed in the tube body 12 adjacent area(s) other than the brazing migration area(s) A. It is believed that together the smaller flow passages 14, 14" have an average hydraulic diameter and/or width that is less than the average hydraulic diameter and/or width of the larger flow passages 14, 14'. It is believed that the hydraulic diameters $D_2$ and/or width of the smaller flow passages 14, 14" function efficiently, in part because such flow passages 14, 14" are not subjected to brazing migration because of their positioning in the tube body 12. In some embodiments, the location of the smaller flow passages 14, 14" is near a center C of the tube body 12, and between the two sets/groups G1 of larger, exterior flow passages 14, 14'. The smaller flow passages 14, 14" positioned adjacent the center C are also referred to herein as interior flow passages 14, 14".

Generally, the average hydraulic diameter and/or width of the larger flow passages 14, 14' is greater than the average hydraulic diameter and/or width of the smaller flow passages 14, 14", but is less than twice the average hydraulic diameter and/or width of each of the smaller flow passages 14, 14". It is believed that the difference in the average hydraulic diameters and/or widths between the smaller flow passages 14, 14" and the larger flow passages 14, 14' advantageously reduces or eliminates the by-pass phenomenon. In an embodiment, the ratio of the average larger hydraulic diameter and/or width to the average smaller hydraulic diameter and/or width ranges from about 1.1 to about 1.5. As non-limiting examples, the ratio of the average larger hydraulic diameter and/or width to the average smaller hydraulic diameter and/or width may be 1.15 or 1.3. In an embodiment, the average larger hydraulic diameter and/or width is equal to or less than 0.60 mm and the average smaller hydraulic diameter and/or width is equal to or greater than 0.20 mm. In another embodiment, the average larger hydraulic diameter and/or width is greater than 0.3 mm.

Referring now to FIG. 3, a cross-sectional view of the tube 10' (similar to the view taken along line 2-2 of FIG. 1C) is depicted. In this embodiment, first and second pluralities of larger flow passages 14, 14' (exterior flow passages) are formed near the sides S1, S2, and a plurality of smaller flow passages 14, 14" (interior flow passages) are formed near the center C. It is to be understood that the description of the average and individual hydraulic diameters $D_1$, $D_2$ and/or widths of the respective flow passages 14, 14', 14" shown in FIG. 2 applies to the embodiment shown in FIG. 3.

While the brazing migration area(s) A are not shown in FIG. 3, it is to be understood that such area(s) A may be considered when forming the flow passages 14, 14', 14" in the tube 10'.

In the embodiment shown in FIG. 3, the tube body 12 also includes a third plurality/set/group G3 of flow passages 14, 14''' defined therein that are positioned intermediate the larger flow passages 14, 14' (e.g., group G1) and the smaller flow passages 14, 14" (e.g., group G2). Generally, the group G3 of intermediate flow passages 14, 14''' has an average hydraulic diameter and/or width that is between the average hydraulic diameters and/or widths of the larger and smaller flow passages 14, 14', 14". As such, the hydraulic diameter $D_3$ and/or width of respective intermediate flow passages 14, 14''' may be larger than the hydraulic diameter $D_2$ and/or width of one or more of the smaller flow passage(s) 14, 14" and may be smaller than the hydraulic diameter $D_1$ and/or width of the larger flow passage(s) 14, 14'. It is to be understood that the intermediate flow passages 14, 14''' may all have the same hydraulic diameter $D_3$ and/or width, or some or all may have varying hydraulic diameters and/or widths. For example, those intermediate flow passages 14, 14''' in closer proximity to the larger flow passages 14, 14' may have a slightly larger diameter $D_3$ and/or width than those intermediate flow passages 14, 14''' in closer proximity to the smaller flow passages 14, 14". In still another non-limiting example, the hydraulic diameter $D_3$ and/or width of each intermediate flow passage 14, 14''' may decrease moving from the larger flow passages 14, 14' to the smaller flow passages 14, 14". As previously described, it is to be understood that while the hydraulic diameters $D_3$ and/or width of the intermediate flow passages 14, 14''' may vary, the average hydraulic diameter and/or width of such passages 14, 14''' is between the respective hydraulic diameter and/or width average of the larger flow passages 14, 14' and the smaller flow passages 14, 14".

In a non-limiting example, the average hydraulic diameter and/or width of the larger flow passages 14, 14' ranges from about 0.58 mm to about 0.60 mm, the average hydraulic diameter and/or width of the smaller flow passages 14, 14" ranges from about 0.50 mm to about 0.54 mm, and the average hydraulic diameter and/or width of the intermediate flow passages 14, 14''' ranges from about 0.55 mm to about 0.57 mm.

Embodiments of the heat exchanger tubes 10, 10' disclosed herein advantageously include larger flow passages 14, 14' and smaller flow passages 14, 14". It is believed that 1) varying flow passage hydraulic diameters and/or widths and 2) positioning such flow passages 14, 14', 14" at particular areas along the tube body 12 advantageously reduces flow passage plugging and fluid by-passing, thereby increasing heat exchanger 100 and/or heat exchanger assembly 1000 efficiency.

It is to be understood that any desirable number of larger flow passages 14, 14' and smaller flow passages 14, 14" may be formed in the tubes 10, 10'. As a non-limiting example, the number of larger (exterior) flow passages 14, 14' make up from about 5% to about 30% of the total number of flow passages 14, 14', 14" in the heat exchanger tube 10, 10', depending, at least in part, on the length and width of the tube 10, 10'.

While several embodiments have been described in detail, it will be apparent to those skilled in the art that the disclosed embodiments may be modified. Therefore, the foregoing description is to be considered exemplary rather than limiting.

What is claimed is:

1. A heat exchanger, comprising:

a heat exchanger tube, including:

a tube body having two opposed sides;

a plurality of exterior flow passages defined in the tube body adjacent one of the two opposed sides;

a second plurality of exterior flow passages defined in the tube body adjacent an other of the two opposed sides;

a plurality of interior flow passages defined:

in the tube body adjacent the plurality of exterior flow passages; and between the plurality of exterior flow passages and the second plurality of exterior flow passages;

a plurality of intermediate flow passages defined in the tube body between i) the plurality of exterior flow passages and the plurality of interior flow passages and ii) the second plurality of exterior flow passages and the plurality of interior flow passages;

the plurality of exterior flow passages having at least one of an average hydraulic diameter or an average width that is i) greater than at least one of an average hydraulic diameter or an average width of the interior flow passages and ii) less than twice the at least one of the average hydraulic diameter or the average width of the interior flow passages;

the second plurality of exterior flow passages having at least one of an average hydraulic diameter or an average width that is i) greater than the at least one of the average hydraulic diameter or the average width of the interior flow passages and ii) less than twice the at least one of the average hydraulic diameter or the average width of the interior flow passages; and the intermediate flow passages having at least one of an average hydraulic diameter and an average width that is between the at least one of the average hydraulic diameter or the average width of the exterior flow passages and the at least one of the average hydraulic diameter or the average width of the interior flow passages;

wherein each flow passage of the plurality of exterior flow passages, the second plurality of exterior flow passages, the plurality of interior flow passages, and the plurality of intermediate flow passages is to be in fluid communication with a same end tank.

2. The heat exchanger as defined in claim 1 wherein the at least one of the average hydraulic diameter or the average width of exterior flow passages ranges from about 0.58 mm to about 0.60 mm, wherein the at least one of the average hydraulic diameter or the average width of the interior flow passages ranges from about 0.50 mm to about 0.54 mm, and wherein the at least one of the average hydraulic diameter or the average width of the intermediate flow passages ranges from about 0.55 mm to about 0.57 mm.

3. The heat exchanger as defined in claim 1 wherein each of the exterior and interior flow passages are fluidly separate from each of the other exterior and interior flow passages.

4. The heat exchanger as defined in claim 1 wherein a ratio of the at least one of the average hydraulic diameter or the average width of the exterior flow passages to the at least one of the average hydraulic diameter or the average width of the interior flow passages ranges from about 1.1 to about 1.5.

5. The heat exchanger as defined in claim 1 wherein the at least one of the average hydraulic diameter or the average width of the exterior flow passages and the at least one of the average hydraulic diameter or the average width of the interior flow passages are configured together to increase thermal performance and reduce flow passage plugging of the heat exchanger tube.

6. The heat exchanger as defined in claim 1 wherein the at least one of the average hydraulic diameter or the average width of the exterior flow passages is equal to or less than 0.60 mm, and wherein the at least one of the average hydraulic diameter or the average width of the interior flow passages is equal to or greater than 0.20 mm.

7. The heat exchanger as defined in claim 1 wherein the at least one of the average hydraulic diameter or the average width of the exterior flow passages is greater than 0.30 mm.

8. The heat exchanger as defined in claim 1 wherein at least one exterior flow passage in the plurality of exterior flow passages has at least one of a hydraulic diameter or width that is different than at least one other exterior flow passage in the plurality of exterior flow passages.

9. The heat exchanger as defined in claim 1 wherein at least one interior flow passage in the plurality of interior flow passages has at least one of a hydraulic diameter or width that is different than at least one other interior flow passage in the plurality of interior flow passages.

10. The heat exchanger as defined in claim 1 wherein the plurality of exterior flow passages make up from about 5% to about 30% of a total number of flow passages in the heat exchanger tube.

11. A method for enhancing thermal performance and reducing flow passage plugging of a heat exchanger tube in a heat exchanger, the method comprising:

defining a plurality of exterior flow passages in a tube body adjacent one of two opposed sides of the tube body, wherein the plurality of exterior flow passages has at least one of a first predetermined average hydraulic diameter or a first predetermined average width;

defining a plurality of interior flow passages in the tube body adjacent the plurality of exterior flow passages, wherein the plurality of interior flow passages has at least one of a second predetermined average hydraulic diameter or a second predetermined average width;

the at least one of the first predetermined average hydraulic diameter or first predetermined average width being i) greater than the at least one of the second predetermined average hydraulic diameter or the second predetermined average width and ii) less than twice the at least one of the second predetermined average hydraulic diameter or the second predetermined average width;

defining a second plurality of exterior flow passages in the tube body adjacent an other of the two opposed sides, the second plurality of exterior flow passages having at least one of a third predetermined average hydraulic diameter or a third predetermined average width that is i) greater than the at least one of the second predetermined average hydraulic diameter or the second predetermined average width and ii) less than twice the at least one of the second predetermined average hydraulic diameter or the second predetermined average width; and defining a plurality of intermediate flow passages in the tube body between i) the plurality of exterior flow passages and the plurality of interior flow passages and ii) the second plurality of exterior flow passages and the plurality of interior flow passages, and wherein the intermediate flow passages have at least one of a fourth predetermined average hydraulic diameter or a fourth predetermined average width that is between i) at least one of a) the at least one first predetermined average hydraulic diameter or first predetermined average width or b) the at least one of the third predetermined average hydraulic diameter or the third predetermined average width and ii) the at least one of the second predetermined average hydraulic diameter or the second predetermined average width;

wherein each flow passage of the plurality of exterior flow passages, the second plurality of exterior flow passages, the plurality of interior flow passages, and the plurality of intermediate flow passages is to be in fluid communication with a same end tank.

12. The method as defined in claim 11 wherein at least one of the first and third predetermined average hydraulic diameters or the first and third predetermined average widths range from about 0.58 mm to about 0.60 mm, wherein the at least one of the second predetermined average hydraulic diameter or the second predetermined average width ranges from about 0.50 mm to about 0.54 mm, and wherein the at least one of the fourth predetermined average hydraulic diameter or the fourth predetermined average width ranges from about 0.55 mm to about 0.57 mm.

13. The method as defined in claim 11, further comprising fluidly separating each of the exterior and interior flow passages from each of the other exterior and interior flow passages during defining.

14. The method as defined in claim 11 wherein at least one of the first predetermined average hydraulic diameter or the first predetermined average width ranges from about 0.30 mm to about 0.60 mm.

15. A heat exchanger assembly, comprising:

a first end tank;

a second end tank opposite the first end tank;

a plurality of tubes in fluid communication with the first and second end tanks;

a plurality of fins disposed between each of the tubes; and at least one tube in the plurality of tubes including:

a tube body having two opposed sides;

a plurality of exterior flow passages defined in the tube body adjacent one of the two opposed sides;

a plurality of interior flow passages defined in the tube body adjacent the plurality of exterior flow passages;

the plurality of exterior flow passages having at least one of an average hydraulic diameter or an average width that is i) greater than at least one of an average hydraulic diameter or an average width of the interior flow passages and ii) less than twice the at least one of the average hydraulic diameter or the average width of the interior flow passages;

a second plurality of exterior flow passages defined in the tube body adjacent an other of the two opposed sides, the second plurality of exterior flow passages having at least one of an average hydraulic diameter or an average width that is i) greater than the at least one of the average hydraulic diameter or the average width of the interior flow passages and ii) less than twice the at least one of the average hydraulic diameter or the average width of the interior flow passages, and wherein the plurality of interior flow passages is defined between the plurality of exterior flow passages and the second plurality of exterior flow passages; and a plurality of intermediate flow passages defined in the tube body between i) the plurality of exterior flow passages and the plurality of interior flow passages and ii) the second plurality of exterior flow passages and the plurality of interior flow passages, and wherein the intermediate flow passages have at least one of an average hydraulic diameter and an average width that is between the at least one of the average hydraulic diameter or the average width of the exterior flow passages and the at least one of the average hydraulic diameter or the average width of the interior flow passages wherein each flow passage of the plurality of exterior flow passages, the second plurality of exterior flow passages, the plurality of interior flow passages, and the plurality of intermediate flow passages is to be in fluid communication with a same end tank.

16. The heat exchanger assembly as defined in claim 15 wherein the at least one of the average hydraulic diameter or the average width of the exterior flow passages ranges from about 0.58 mm to about 0.60 mm, wherein the at least one of the average hydraulic diameter or the average width of the interior flow passages ranges from about 0.50 mm to about 0.54 mm, and wherein the at least one of the average hydraulic diameter or the average width of the intermediate flow passages ranges from about 0.55 mm to about 0.57 mm.

17. A heat exchanger, comprising:

a heat exchanger tube, including:

a tube body having two opposed sides;

an external flow passage defined in the tube body adjacent each of the two opposed sides, each of the external flow passages having at least one of a first predetermined hydraulic diameter or a first predetermined width;

a first internal flow passage defined in the tube body adjacent each of the external flow passages, each of the first internal flow passages having the at least one of the first predetermined hydraulic diameter or the first predetermined width;

a second internal flow passage defined in the tube body adjacent each of the first internal flow passages, each of the second internal flow passages having at least one of a second predetermined hydraulic diameter or a second predetermined width that is smaller than the at least one of the first predetermined hydraulic diameter or the first predetermined width; and a third internal flow passage defined in the tube body adjacent each of the second internal flow passages, each of the third internal flow passages having at least one of a third predetermined hydraulic diameter or a third predetermined width that is smaller than the at least one of the second predetermined hydraulic diameter or the second predetermined width;

wherein a ratio of the at least one of the first predetermined hydraulic diameter or the first predetermined width to the at least one of the third predetermined hydraulic diameter or the third predetermined width ranges from about 1.1 to about 1.5;

and wherein the external flow passages, the first internal flow passage, the second internal flow passage, and the third internal flow passage are each to be in fluid communication with a same end tank.

* * * * *